US005081923A

United States Patent [19]

LaMantia et al.

[11] Patent Number: 5,081,923

[45] Date of Patent: * Jan. 21, 1992

[54] METHOD OF CREATING A REGISTERED PATTERN ON A METAL COIL AND ASSOCIATED APPARATUS

[75] Inventors: Philip J. LaMantia, Verona; George Hardick; Ralph Campbell, both of Pittsburgh, all of Pa.

[73] Assignee: Enamel Products & Plating Company, McKeesport, Pa.

[ * ] Notice: The portion of the term of this patent subsequent to Aug. 6, 2008 has been disclaimed.

[21] Appl. No.: 633,009

[22] Filed: Dec. 24, 1990

Related U.S. Application Data

[62] Division of Ser. No. 502,107, Mar. 29, 1990, Pat. No. 5,037,665.

[51] Int. Cl.[5] ..... B44B 5/00

[52] U.S. Cl. ..... 101/32; 101/6; 101/23

[58] Field of Search ..... 427/8, 293, 287; 118/40, 210, 697, 712, 672, 674; 72/37, 191, 8; 101/5, 6, 22, 23, 32

[56] References Cited

U.S. PATENT DOCUMENTS

| | | | |
|---|---|---|---|
| 2,366,187 | 1/1945 | Firedwald | 118/40 X |
| 3,030,915 | 4/1962 | Shannon | 118/669 X |
| 3,543,554 | 12/1970 | Hoagland et al. | 72/191 X |
| 3,559,568 | 2/1971 | Stanley | 101/32 |
| 3,934,505 | 1/1976 | Kushner | 101/129 |
| 4,426,898 | 1/1984 | Friberg | 83/37 |

OTHER PUBLICATIONS

Begemau, M. L., "Manufacturing Processes", 4th edition, New York, John Wiley & Sons, 1957, p. 274.

"Forming Alcoa Aluminum", Pittsburgh, Pa., Aluminum Company of America, 1961, pp. 127-131.

*Primary Examiner*—Evan Lawrence

*Attorney, Agent, or Firm*—Arnold B. Silverman

[57] ABSTRACT

A method for creating a registered embossed pattern on a metal coil includes providing a pattern applicator roll and a drive motor for rotating the roll, moving the coil sequentially into contact with the applicator roll means and permit it to create a pattern on the moving strip. Measuring the pattern length and comparing the same with the desired pattern length. Adjusting the speed of rotation of the pattern applicator roll if the measured pattern length departs from the desired pattern length by a predetermined amount preferably coil line speed is also monitored. A microprocessor may be used to effect the comparison between the desired pattern length and the actual pattern length. Apparatus for creating a registered embossed pattern on a metal coil includes a pattern applicator roll which has the strip from the coil moved into contacting relationship therewith, an appropriate drive motor to drive the roll, and apparatus for monitoring coil line speed, pattern length and motor speed. A microprocessor stores the desired pattern length and receives information regarding line speed, pattern length, and motor speed and where an adjustment is desired, either speeds up the applicator roll where the pattern length is longer than the desired pattern length, or reduces the applicator roll speed, if the pattern length is less than the desired pattern length.

18 Claims, 2 Drawing Sheets

METHOD OF CREATING A REGISTERED PATTERN ON A METAL COIL AND ASSOCIATED APPARATUS

This is a division, of application Ser. No. 07/502,107, filed Mar. 29, 1990, now U.S. Pat. No. 5,037,665.

BACKGROUND OF THE INVENTION

1. Field of the Invention

The present invention relates to a method of establishing a registered pattern on a metal coil and associated apparatus and, more specifically, it relates to such a system that is adapted for precise control of the pattern so as to facilitate more efficient use of the metal coil in making products therefrom.

2. Description of the Prior Art

It has been known to manufacture products by creating repeated patterns of printed elements on metal coil and, subsequently, severing portions of the metal coil each containing one of the patterns and forming the same into products. Among the many uses for such coils have been the manufacture of packaging and building products such as can end stock and doors, for example.

One of the problems with such coils is that even minor departures from tolerances in the longitudinal direction could have a sufficiently large cumulative effect that an end user may have substantial waste material. An end user having punch presses set up to punch out portions of the coil at predetermined locations can create a defective product as a result. If the predetermined pattern departs from the those locations, the portion of the metal punched out will not contain the full patterned image.

While such punching of patterns from parent stock can be accomplished within tolerances easily when discrete sheets of relatively small lengths are employed, there remains a problem with long coils of metal.

SUMMARY OF THE INVENTION

The present invention has provided a solution to the above-described problem.

The method of the present invention involves creating a registered pattern on a metal coil by providing pattern applicator roll means and drive means for rotating the pattern applicator roll means. The coil stock is sequentially moved by, and into contact with, the applicator roll means which deposits a pattern on the moving coil at predetermined locations. The pattern length on the coil is measured as is the coil line speed. The measured pattern is compared with the desired pattern length. If the comparison results in the conclusion that there is a departure from the desired pattern length by a predetermined amount, the speed of rotation of the pattern applicator roll means is altered in order to adjust to pattern length. When the measured pattern length is less than the desired pattern length, the speed of rotation of the pattern applicator roll means is reduced. Similarly, when the measured pattern length is longer than the desired pattern length, the speed rotation of the pattern applicator roll means is increased.

The apparatus for creating the registered pattern on the metal coil includes a pattern applicator roll means for applying the pattern to the moving metal coil, means for moving the coil sequentially into contact with the pattern applicator roll means, and drive means for rotating the pattern applicator roll means. Coil line speed monitoring means, pattern length monitoring means and motor speed monitoring means are provided. Microprocessor means containing information regarding the desired pattern length is provided and receives information from the various monitoring means subsystems.

It is an object of the present invention to provide a system which creates a precisely controlled registered pattern on a metal coil.

It is another object of the present invention to provide such a system which is adapted to be used with printing, coating, coining and other means of providing discrete patterns on a metal surface.

It is another object of the present invention to provide such a system which is adapted to control tolerances, both in a longitudinal coil direction and a transverse direction.

It is another object of the present invention to provide such a system which has appropriate servomechanisms and an associated microprocessor.

It is a further object of the present invention to provide such a system which may readily be retrofit into existing coil processing apparatus.

These and other objects of the invention will be more fully understood in the description of the invention with reference to the illustrations appended hereto.

DESCRIPTION OF THE PREFERRED EMBODIMENT

As used herein, the term "pattern" means a series of similar or identical relatively spaced portions on a metal coil established by printing, coating, coining, or combinations thereof, and other means of altering the appearance or contour of portions of the coil.

As used herein, "pattern unit" means a single pattern portion which is repeated to create a pattern.

As used herein, "registered pattern" means a repeated pattern unit established with a predetermined dimensional relationship of the pattern units to each other or to the coil or both.

The term "pattern length" means the distance between two identical portions of adjacent patterned units in the longitudinal direction.

Figure 1:
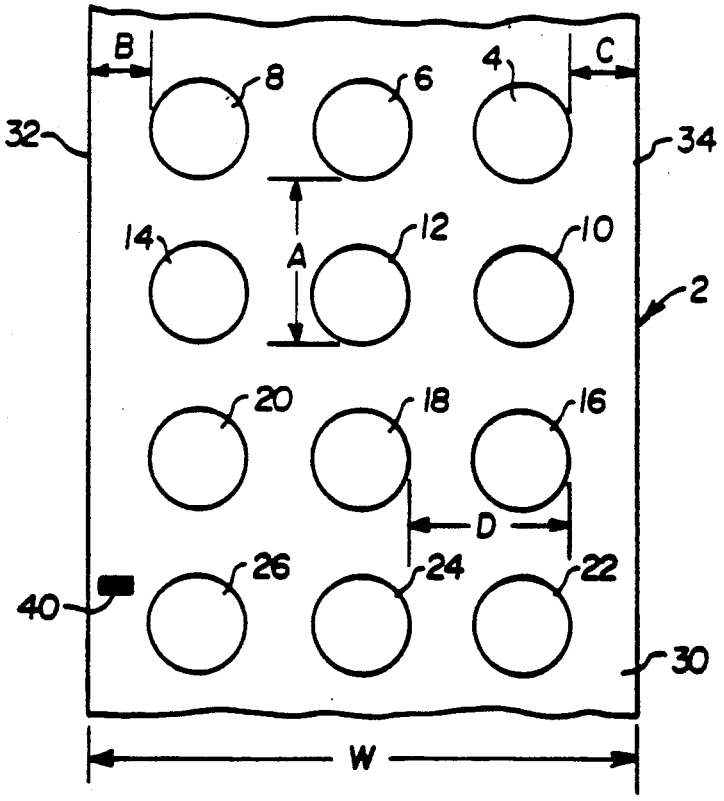
FIG. 1 is a schematic partial plan view of a form of patterned coil of the present invention.

Referring now more specifically to FIG. 1, there is shown an elongated section 2 of a metal coil having a width W. This section has a pattern which is made up of a plurality of pattern units 4, 6, 8, 10, 12, 14, 16, 18, 20, 22, 24, 26. These pattern units may be established of any shape or size relative to the strip 30 by any desired means. It is noted that the patterns, as shown, have a pattern length A, which in the form shown, has been measured between an end of pattern unit 6 and a corresponding end of pattern unit 12. The transverse distance between two patterns, which may be designated as the "pattern width," is indicated by the letter D, as shown between pattern units 16 and 18. Pattern unit 8 has an edge which is a distance B from edge 32 of the coil, and pattern unit 4 has an edge which is at a distance C from coil edge 34. It will be appreciated that in measuring distances between patterns or patterns and coil edges, any desired reference point on the pattern unit may be employed.

In monitoring the establishment of a registered pattern in accordance with the system of the present invention, the desired pattern length A and pattern width D will be compared with the actual measured pattern length or width in order to determine if there has been a departure from the desired positioning.

Also shown in FIG. 1 is a registration mark 40 on the coil portion 30. This may be employed by the end user who converts the registered pattern coil into a plurality of individual products in order to facilitate registration of the coil with the end user's processing equipment. A plurality of such registration marks 40 may be positioned at longitudinally spaced locations on the coil. In the alternative, the end user may employ a part of the pattern as a reference to set up his or her processing equipment.

Figure 2:
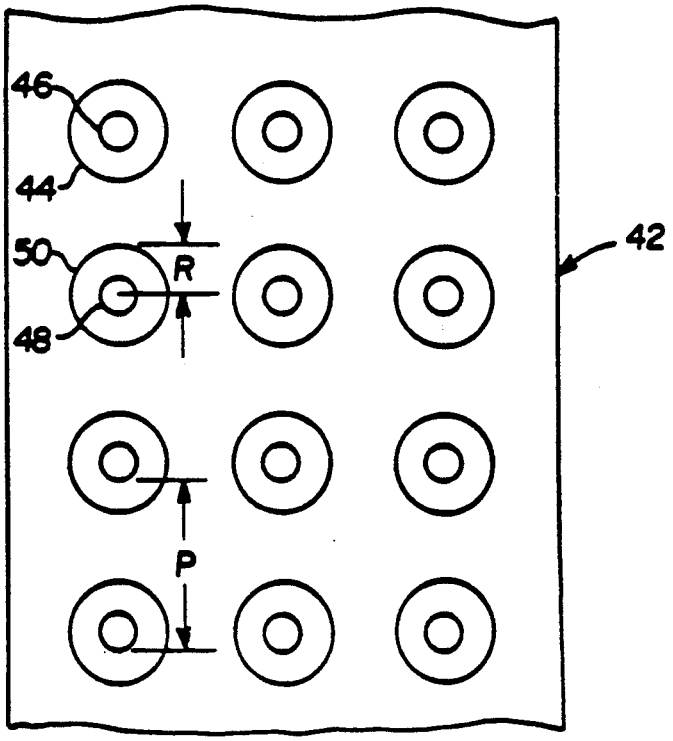
FIG. 2 is similar to FIG. 1, but with a modified pattern.

Referring to FIG. 2, there is shown a coil section which has a plurality of pattern units of a different nature. In this embodiment, the pattern unit may have an outer image 44 within which an inner image 46 has been provided. These two images may take different forms. For example, pattern element 44 may be of one color or one graphic concept with pattern element 46 being of a different color or a different graphic concept. In the alternative, one of the two elements 44, 46 may have been established through metal deformation as by coining, for example, and the other through application of the different material as by coating or printing. Indexing in this context may be employed by using a reference such as the pattern length P measured from the center patterns, or monitoring the relationship between one element to another, such as maintaining the distance R between the center of pattern element 48 and the periphery of pattern element 50.

Figure 3:
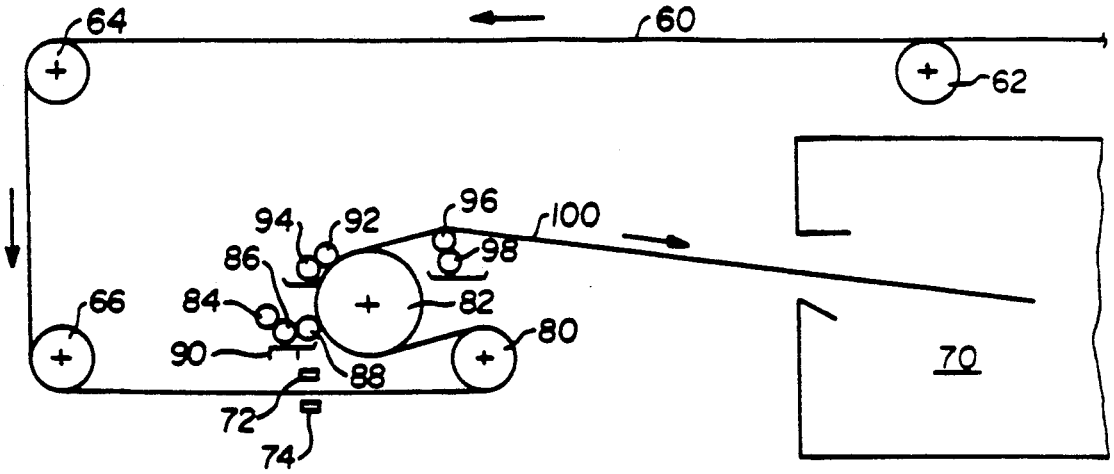
FIG. 3 is a schematic illustration showing a type of coil processing system usable in the present invention.

Referring now more specifically to FIG. 3, a schematic illustration of a typical coil processing line for establishing a pattern on metal coil is shown. The coil strip 60, traveling in the direction indicated by the arrows, is supported by the idle roll 62, steering rolls 64, 66 and, ultimately, after application of the pattern enters oven 70 for drying of the pattern. If the operation involves a pattern which does not require curing as in certain coatings or metal forming, the oven 70 may be eliminated.

In the pattern applying section of the apparatus, the coil strip 60 passes sequentially between a pair of optical sensors 72, 74 which facilitates steering, i.e., appropriate lateral positioning of the rolls with respect to the apparatus. In maintaining side-to-side control through the optical means 72, 74 steering devices known to those skilled in the art may be employed. A suitable device is that available from either North American Steering or Fife Corporation and will consist of a two-roll, side-to-side steering means with strip centering photo-optics. The optical system senses the lateral position of the coil and transmits a signal through a high speed power unit which, in turn, may activate a hydraulic cylinder to correct the position of the strip before it drifts out of tolerances.

The coil then moves over rolls 80, 82. The parent pattern applicator roll means, in the form shown, includes a metering roll 84 which cooperates with a pick-up roll 86 to facilitate application of the appropriate amount of material at the appropriate positions on the coil strip 60. The applicator roll 88 receives material from the pick-up roll 80 which has obtained the same from the reservoir 90, and through rolling contact with the coil 60, applies the material thereto. When desired, the additional rolls 92, 94 and 96, 98 may be employed to apply additional patterns or coatings to the coil strip 60. The coil portion 100, with the registered pattern applied, then enters the oven 70.

Figure 4:
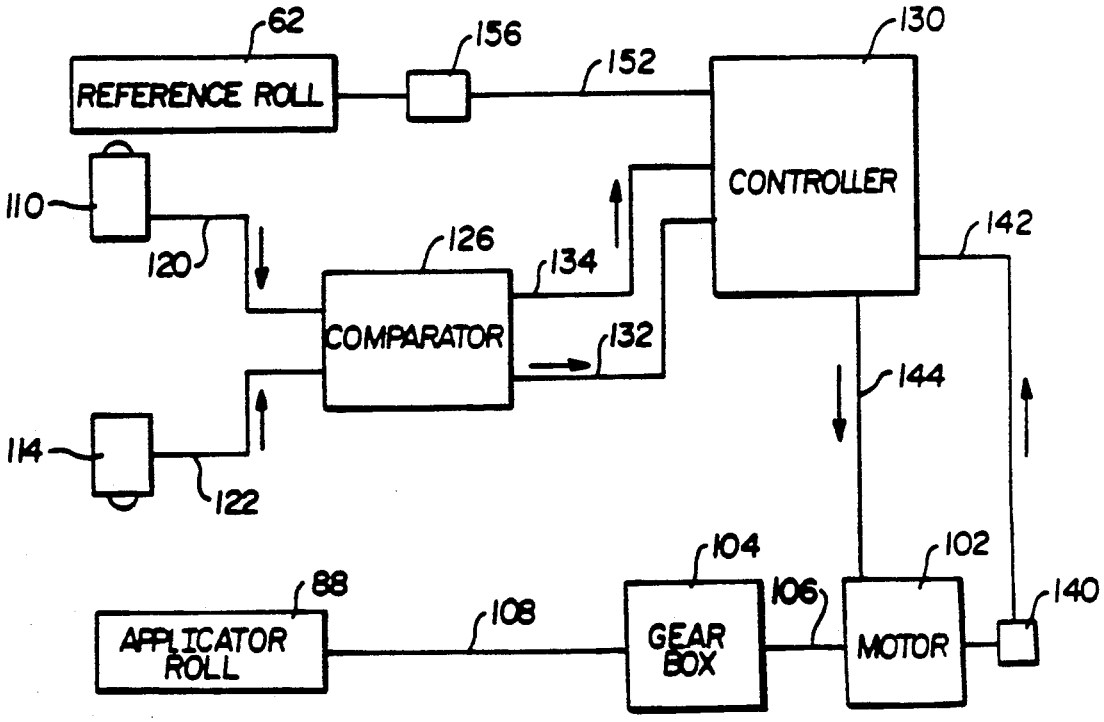
FIG. 4 is a flow diagram of the system of one embodiment of the present invention.

With reference to FIG. 4, the method of the present invention for applying the registered pattern will now be considered. It is contemplated that the present invention can control pattern length with great precision so as to establish a coil which can be employed by the end user who makes a plurality of individual products out of the coil with a minimum of scrap and loss of product.

In the form shown, the applicator roll 88 is rotated by a motor 102 which may be a suitable DC motor through gear box 104 with appropriate connecting drive shafts 106, 108. For simplicity of disclosure, direct drive of applicator roll 88 has been shown. In practice, other arrangements such as the pick-up roll 86 being geared to applicator roll 88 and being driven by motor 102 may be employed. In either case, the motor produces responsive rotation of the applicator roll 88. The line speed of the coil 60 is monitored by means of reference roll 62 which, preferably, has a fixed reference point on it. The reference point will, with each revolution, pass in front of photo-cell 110, thereby permitting the photo-cell to provide output pulses corresponding to the line speed of the coil 60. Similarly, photo-cell 114 will measure the pattern length of each of the patterns being applied to the coil by pattern applicator roll means 88 and emit responsive output pulses. The line speed and pattern length will respectively be delivered by lines 120, 122 to comparator 126 which contains information regarding the desired pattern length. It makes a comparison between the desired pattern length and the actual measured pattern length and also employs the information regarding the line speed which should be constant. If there is a difference between the actual and desired pattern lengths, and if such difference exceeds a predetermined limit, comparator 126 will issue a corrective signal to controller 130. If the actual measured pattern length is less than the desired pattern length, the comparator 126 will issue a signal over line 132 to controller 130 to decrease the roll speed of the pattern applicator roll means 88. If the measured pattern length is greater than the desired pattern length, the comparator 126 will issue a signal over line 134 to controller 130 to increase the roll speed of pattern applicator roll means 88. A suitable comparator is that sold by HB Registration Corporation of New Jersey as a registration device under the trade designation "Length-O-Trol II."

The controller 130 receives information regarding the rotational speed of motor 102 by means of tachometer 140. Tachometer 140 provides a plurality of pulses which may be on the order to 240 pulses per motor revolution, for example, over line 142 to controller 130. The controller's output signal which is responsive to information received from comparator 126, and tachometer 140 is delivered by line 144 to motor 102 to alter the speed in the appropriate manner where such action is desired.

Controller 130 may be a controller available from General Electric and may be of the direct current Series Six DC 300 drive control variety.

The controller 130 also receives information regarding the line speed through reference roll 62, its associated tachometer 156 and line 152. Tachometer 156 also provides information in the form of pulses which may be on the order of 2,500 pulses per revolution, for example. The controller 130 employs this information to very accurately determine line speed of the strip.

It will be appreciated that for convenience of reference herein, in referring to the manner of establishing a registered pattern, reference has been made to a pattern applicator roll means. It will be understood that such an expression shall be deemed to be broad enough to include all sorts of means of depositing material on a coil, as well as metal forming apparatus such as embossing rolls or rolls which coin the metal.

By way of example, the reference roll 62, employed in determining line speed, may have a circumference on the order of 17.125 inches. The gear box 104 may have having a ratio of 1839/2.02.1, the pulley a one-to-one ratio, and the pattern applicator roll may have a circumference of about 24.75 inches. Where embossing or coining is contemplated, the reference roll 62 may have a circumference of 14.460 inches, the gear box a ratio of 1,900/136, the pulley a ratio of 3.11 to 1, with the embossing roll having a circumference of 80.75 inches. Generally, the metal coils will be composed of aluminum or steel, as well as alloys thereof and may, for example, have a thickness of about 0.005 to 0.85 inches with the width ranging from one-half inch to 72 inches. By the system for the present invention, tolerances on the registered pattern may be maintained within the range of ±1/64th of an inch or better.

If desired, the microprocessor means which convenience of reference may be deemed to consist of the comparator 126 and controller 130, as well as associated connections, may be programmed by any suitable means well known to those skilled in the art. If desired, the microprocessor means may be provided with means to record sections of the coil wherein departures from the desired pattern length have been experienced. This recorded history of the coil may be delivered to the end user who can then employ this information to cause the manufacturing equipment to skip over those portions of the coil where tolerances have been exceeded.

Whereas particular embodiments of the invention have been described above for purposes of illustration, it will be apparent to those skilled in the art that numerous variations of the details may be made without departing from the invention as defined in the appended claims.

We claim:

1. A method for creating a registered pattern on a metal coil comprising providing pattern applicator roll means and drive means for rotating said applicator roll means, moving said metal coil sequentially into contacting relationship with said applicator roll means, establishing a pattern on said moving coil by said pattern applicator roll means by deforming said metal coil by embossing, measuring the pattern length and comparing the same with the desired pattern length, and adjusting the speed of rotation of said pattern applicator roll means if the measured pattern length departs from the desired patterned length by a predetermined amount.

2. The method of claim 1 including monitoring coil line speed.

3. The method of claim 2 including measuring said line speed by means of a reference roll which contacts said moving strip.

4. The method of claim 3 including reducing the speed of said pattern applicator roll means if said pattern length is less than the desired pattern length.

5. The method of claim 4 including increasing the speed of said pattern applicator roll means if said pattern length is longer than the desired pattern length.

6. The method of claim 5 including employing microprocessor means to effect said comparison between said measured pattern length and said desired pattern length.

7. The method of claim 6 including employing optical sensing means in cooperation with said reference roll to measure said line speed.

8. The method of claim 7 including employing optical sensing means to measure said pattern length.

9. The method of claim 8 including providing said drive means with motor means, and monitoring the speed of said motor means by tachometer means.

10. The method of claim 8 including delivering to said microprocessor pulses from said tachometer which correspond to the speed of said motor.

11. The method of claim 6 including employing comparator means within said microprocessor means to effect said comparison, and providing output signals from said comparator means to controller means within said microprocessor means when an adjustment to said applicator roll means speed of rotation is to be made.

12. The method of claim 11 including effecting said applicator roll means speed adjustment by an output signal from said controller which adjusts the speed of said motor.

13. Apparatus for creating a registered pattern on a metal coil comprising pattern applicator roll means for applying a pattern sequentially to said coil through deformation of said metal coil using metal embossing means, means for moving said metal coil into contact with said pattern applicator roll means, drive means for rotating said pattern applicator roll means, coil line speed monitoring means for monitoring the line speed of the metal coil, pattern length monitoring means for measuring the pattern length, motor speed monitoring means for measuring speed of rotation of the motor, microprocessor means for receiving information from said coil line speed monitor means, said pattern length monitoring means and said motor speed monitoring means, said microprocessor means containing information regarding the desired pattern length, and said microprocessor means having means for employing all said information to determine whether an adjustment to said motor speed should be made and initiating such an adjustment if the desired pattern length departs from the measured pattern length by a predetermined amount.

14. The apparatus of claim 13 including coil line speed monitoring means for monitoring the line speed of the metal coil, said microprocessor means having means for receiving information from said coil line speed monitoring means, and said microprocessor means having means for employing said line speed information in determining if a said adjustment is needed.

15. The apparatus of claim 14 including said coil line speed monitoring means having a reference roll and optical sensing means.

16. The apparatus of claim 15 including said pattern length monitoring means having optical sensing means.

17. The apparatus of claim 16 including said motor speed monitoring means including tachometer means.

18. The apparatus of claim 17 including said microprocessor means including comparator means for receiving information regarding line speed, pattern length and containing information regarding the desired pattern length in order to effect a comparison between said pattern length and said desired pattern length.

* * * * *